US008029333B2

(12) United States Patent
Takahashi et al.

(10) Patent No.: US 8,029,333 B2
(45) Date of Patent: Oct. 4, 2011

(54) DEVICE FOR POLISHING PERIPHERAL EDGE OF SEMICONDUCTOR WAFER

(75) Inventors: Tamami Takahashi, Tokyo (JP); Kenya Ito, Tokyo (JP); Mitsuhiko Shirakashi, Tokyo (JP); Kazuyuki Inoue, Tokyo (JP); Kenji Yamaguchi, Tokyo (JP); Masaya Seki, Tokyo (JP); Satoru Sato, Akishima (JP); Jun Watanabe, Akishima (JP); Kenji Kato, Akishima (JP); Jun Tamura, Akishima (JP); Souichi Asakawa, Akishima (JP)

(73) Assignees: EBARA Corporation, Tokyo (JP); NIHON Micro Coating Co., Ltd., Tokyo (JP)

( * ) Notice: Subject to any disclaimer, the term of this patent is extended or adjusted under 35 U.S.C. 154(b) by 751 days.

(21) Appl. No.: 11/911,808

(22) Filed: Oct. 17, 2007

(65) Prior Publication Data

US 2009/0093192 A1 Apr. 9, 2009

Related U.S. Application Data

(63) Continuation of application No. PCT/JP2006/308492, filed on Apr. 18, 2006.

(30) Foreign Application Priority Data

Apr. 19, 2005 (JP) ..... 2005-121464

(51) Int. Cl.
*B24B 49/00* (2006.01)

(52) U.S. Cl. ..... 451/8; 451/11; 451/44

(58) Field of Classification Search ..... 451/8, 11, 451/44, 159, 285
See application file for complete search history.

(56) References Cited

U.S. PATENT DOCUMENTS

| | | | | |
|---|---|---|---|---|
| 5,185,965 | A * | 2/1993 | Ozaki | 451/5 |
| 5,271,185 | A * | 12/1993 | Hosokawa | 451/136 |
| 5,458,529 | A * | 10/1995 | Hasegawa et al. | 451/177 |
| 6,334,229 | B1 * | 1/2002 | Moinpour et al. | 15/77 |
| 6,431,961 | B1 * | 8/2002 | Katayama et al. | 451/44 |
| 2003/0134570 | A1 * | 7/2003 | Hakomori | 451/5 |
| 2004/0185751 | A1 * | 9/2004 | Nakanishi et al. | 451/5 |
| 2005/0159083 | A1 * | 7/2005 | Liao et al. | 451/41 |
| 2008/0188167 | A1 * | 8/2008 | Ishii et al. | 451/307 |

FOREIGN PATENT DOCUMENTS

| | | |
|---|---|---|
| JP | 06-047655 | 2/1994 |
| JP | 07-009321 | 1/1995 |
| JP | 08-090401 | 4/1996 |
| JP | 11-320363 | 11/1999 |

* cited by examiner

*Primary Examiner* — Maurina Rachuba
(74) *Attorney, Agent, or Firm* — Weaver Austin Villeneuve & Sampson LLP

(57) ABSTRACT

A device for polishing the peripheral edge part of a semiconductor wafer includes a wafer stage for holding the wafer, a wafer stage unit including devices for rotating the wafer stage, causing the wafer stage to undergo a rotary reciprocating motion within the same plane as the surface of the wafer stage, and moving the wafer stage parallel to the surface, a notch polishing part for polishing the notch on the wafer and a bevel polishing part for polishing the beveled part of the wafer. Pure water is supplied to the wafer to prevent it from becoming dry as it is transported from the notch polishing part to the bevel polishing part.

28 Claims, 14 Drawing Sheets

DEVICE FOR POLISHING PERIPHERAL EDGE OF SEMICONDUCTOR WAFER

This application is a continuation of International Application No. PCT/JP2006/308492 filed Apr. 18, 2006, that was amended on Sep. 14, 2006 and claims priority on Japanese Patent Application 2005-121464 filed Apr. 19, 2005.

TECHNICAL FIELD

This invention relates to a device for polishing the peripheral edge part (including the notch and the beveled part) of a semiconductor wafer.

BACKGROUND ART

The peripheral edge part of a semiconductor wafer is conventionally polished by independently using a device for polishing the notch part (as disclosed in Japanese Patent Publication Tokkai 9-85599) and another device for polishing the beveled part (as disclosed in Japanese Patent Publications Tokkai 7-164301 and 8-174399). The polishing of the peripheral part is carried out by a so-called wet method whereby a polishing liquid in a slurry form obtained by dispersing abrading particles in water or a water-based reactive liquid is supplied to the target part to be polished (such as the notch and/or the beveled part) together with cooling water while a tape made of a woven or non-woven cloth or a foamed body or a tape having a polishing layer with abrading particles affixed by an adhesive formed on the surface of a plastic material is pressed onto the target part and caused to run.

Such conventional methods have problems because the notch and the beveled part of a semiconductor wafer are polished independently such that it takes too long to transport the wafer between these two devices and this requires a large space for the equipment. There is also the problem of the semiconductor wafer becoming dry while being transported, adversely affecting the yield of device wafers.

The positioning of a semiconductor wafer on the wafer stage in each polishing device is carried out by means of a pair of chuck handles of a robot for transporting wafers but since a plurality of cylinders are used for improved accuracy in the positioning, a large space is required for the equipment. Since air cylinders are used for the purpose, furthermore, an error on the order of 0.5 mm arises in the positioning. There is still another problem that an excessive grasping force is applied on the peripheral edge of the wafer and tends to damage the edge portion of the wafer.

The semiconductor wafer is adsorbed to the wafer stage by vacuum. When this semiconductor wafer is removed from the wafer stage, the wafer is released from this condition of vacuum adsorption as the wafer is grasped on its peripheral parts by the pair of chuck handles of the robot and lifted up. This means that a large releasing force is required for removing the semiconductor wafer from the wafer stage and this must be exerted instantaneously on the semiconductor wafer. This gives rise to the problem of deforming or damaging the semiconductor wafer.

According to prior art technologies, a polishing tape is supplied from a supply roller during the polishing process by changing the torque value of a motor for the supply of the tape according to the outer diameter of the tape (that is, the amount of the tape still remaining on the supply roll) such that the tension of the tape pressed onto the target portion to be polished can be adjusted. Since the outer diameter of the tape is determined by the presence or absence of light from a light emitter received by a plurality (usually eight) of sensors of a light receiving part arranged at the side of the tape supply roll, the torque value of the motor changes in a stepwise manner, giving rise to the problem of the tension in the tape not being constant.

DISCLOSURE OF INVENTION

It is therefore an object of this invention, which relates to the processing of the peripheral part a semiconductor wafer, to provide a device for polishing the notch and the beveled part of a semiconductor wafer efficiently within a single device.

It is another object of this invention to provide such a device with which the polishing time can be shortened and the space required for the apparatus can be reduced.

It is a third object of this invention to provide such a device capable of positioning a semiconductor wafer accurately on a wafer stage.

It is a fourth object of this invention to provide such a device capable of easily removing a semiconductor wafer supported by adsorption on the wafer stage.

It is a fifth object of this invention to provide such a device capable of maintaining the tension in the tape constant independent of the outer diameter of the tape (or its remaining amount on the supply roll) on the polishing head.

A device according to this invention with which the objects described above can be accomplished is for polishing the peripheral edge part of a semiconductor wafer and comprises a wafer stage having a surface for holding the semiconductor wafer, a wafer stage unit including a stage rotating part for rotating the wafer stage and a reciprocating motion part for causing the wafer stage to undergo a rotary reciprocating motion within the same plane as the surface of the wafer stage, a stage moving part for moving the wafer stage parallel to the surface, and two or more polishing parts for polishing the peripheral edge part of the semiconductor wafer being held by the wafer stage.

These two or more polishing parts include a notch polishing part for polishing a notch on the semiconductor wafer held by the wafer stage and a bevel polishing part for polishing beveled part of the semiconductor wafer held by the wafer stage.

The device of the invention further comprises a housing that contains the wafer stage unit, the polishing parts and the stage moving part and has a side surface with an opening which can be opened and closed. The housing includes two chambers partitioned by a partition plate, one of the chambers containing the wafer stage unit and the polishing parts, and the other of the chambers containing the stage moving part.

The device of the invention further comprises a dryness preventing part for supplying pure water to the semiconductor wafer held by the wafer stage.

The device of the invention further comprises a chuck assembly for receiving the semiconductor wafer transported into the housing, placing the semiconductor wafer on the wafer stage and delivering the semiconductor wafer on the wafer stage to a wafer transporting part. The chuck assembly includes a first chuck hand having two or more knobs, a second chuck hand having two or more knobs, a chuck opening part for opening and closing the first chuck hand and the second chuck hand, and a chuck moving part for causing the first chuck hand and the second check hand to undergo a reciprocating motion perpendicularly to the surface of the wafer stage, wherein the knobs contact peripheral parts of the semiconductor wafer when the first chuck hand and the second chuck hand are closed such that the semiconductor wafer becomes grasped by the first chuck hand and the second chuck hand.

The chuck opening part comprises a ball screw engaging with at least one of the first and second chuck hands and a servo motor for driving the ball screw wherein the first and second chuck hands open and close as the servo motor is activated.

The device of this invention further comprises a sensor assembly having a notch detecting part for detecting the position of a notch on semiconductor wafer being held on the wafer stage by suction. The notch detecting part includes an optical sensor having a light emitter and a light receiver arranged such that the notch on the semiconductor wafer held by the wafer stage by suction passes between the light emitter and the light receiver, the optical sensor serving to detect the position of the notch by rotating the semiconductor wafer.

Preferably, the sensor assembly includes three optical sensors which are first optical sensor, second optical sensor and third optical sensor, the first optical sensor being adapted to detect the position of the notch when the wafer stage is rotating at a rotational speed within a first range, the second optical sensor being adapted to detect the position of the notch when the wafer stage is rotating at a rotational speed within a second range that is slower than the first range, and the third optical sensor being adapted to detect the position of the notch when the wafer stage is rotating at a rotational speed within a third range that is slower than the second range.

The sensor assembly further includes a displacement detecting part for detecting positional displacement in radial direction of the semiconductor wafer held by the wafer stage by suction, the displacement detecting part comprising an optical sensor having a light emitter and a light receiver arranged such that the peripheral edge of the semiconductor wafer held by the wafer stage by suction passes between the light emitter and the light receiver, the optical sensor serving to detect changes in the quantity of light received by the light receiver and to thereby detect a radial displacement of the position of the semiconductor wafer held by the wafer stage by suction.

Preferably, the third sensor is arranged such that the peripheral edge including the notch of the semiconductor wafer held by the wafer stage by suction passes between the light emitter and the light receiver, the third optical sensor serving to detect changes in the quantity of light received by the light receiver thereof and to thereby detect a radial displacement of the position of the semiconductor wafer held by the wafer stage by suction and to detect the position of the notch of the semiconductor wafer when the wafer stage is rotating at a rotary speed within the third range.

The sensor assembly further comprises a waterproofing part for waterproofing the sensor assembly.

The notch polishing part comprises a notch polishing head having a first roller and a second roller arranged parallel to each other with an interval in between and a tape supplying part including a supply roll having a tape wound therearound, a take-up roller for taking up the tape from the supply roll through the first and second rollers and a driving part for driving the take-up roller for taking up the tape, wherein the tape is adapted to be pressed against the notch while passing between the first roller and the second roller to thereby polish the notch.

The tape comprises a tape-shaped base film of a plastic material having a polishing layer with abrading particles fastened by a resin binder.

The notch polishing part further includes a mechanism for causing the notch polishing head to undergo a reciprocating motion perpendicularly to the semiconductor wafer while the tape is pressed against the notch.

The notch polishing part further includes another mechanism for causing the notch polishing head to undergo a rotary reciprocating motion around the notch while the tape is pressed against the notch such that both front and back surface sides of the notch are polished.

Preferably, the notch polishing part further includes a diameter detecting part for detecting the outer diameter of the tape remaining wound around the supply roll.

The bevel polishing part comprises a bevel polishing head having a cylinder with a contact pad attached to an end and a tape supplying part having a supply roll having a tape wound therearound, a take-up roller for winding up the tape from the supply roll through the contact pad, and a driving part for driving the take-up roller for winding up the tape, wherein the tape is pressed against the beveled part while passing on the contact pad and thereby polishes the beveled part.

The tape comprises a tape-shaped base film of a plastic material having a polishing layer with abrading particles fastened by a resin binder.

The bevel polishing part further includes a mechanism for causing the bevel polishing head to undergo a rotary reciprocating motion around the semiconductor wafer while the tape is pressed against the beveled part such that both front and back surface sides of the beveled part are polished.

The bevel polishing part further includes a diameter detecting part for detecting the outer diameter of the tape remaining wound around the supply roll.

The bevel polishing part further includes a displacement detecting part for detecting displacement of the semiconductor wafer while the beveled part is being polished, the displacement detecting part comprising a displacement sensor for detecting change in stretching and shrinking of the cylinder serving to compress the tape to the beveled part through the contact pad while the semiconductor wafer is being polished.

The device of this invention further comprises a cleaning part for maintaining the interior of the housing clean, the cleaning part comprising an air inlet through an upper surface of the housing, an air discharge outlet through a lower side surface of the housing and an external pump connected to the air discharge outlet, the air inlet and the air discharge outlet being arranged such that air flows in through the air inlet and flows inside the housing along side surfaces thereof.

The device of this invention further comprises a structure for waterproofing the other chamber.

Preferably, the partition plate of the device of this invention has an opening, wherein the stage rotating part comprises a first shaft attached to the center on the back of the wafer stage, a support member rotatably attached to the first shaft and a first motor for rotating the first shaft, wherein the reciprocating motion part comprises a second shaft that is affixed to the support member of the wafer stage at a position offset from the center of the wafer stage by approximately the distance of one half of the radius of the semiconductor wafer through the opening through said partition plate and a second motor for rotating the second shaft, the second shaft being rotatably attached to a shaft table that is hollow and cylindrical, the shaft table having a lower surface affixed to a support plate below the partition plate and an upper surface supporting the support member by contacting the lower surface of the support member and the second motor being affixed to the support member, and wherein the device further comprises a hollow semi-spherical waterproofing cover having an upper affixed in a liquid-tight manner to an upper part of the shaft table and a lower part affixed in a liquid-tight manner around the opening through the partition plate, the waterproofing cover being made of an elastic material.

Preferably, the waterproofing cover is of a double structure having an inner cover and an outer cover, said device further comprising an air supplying part for supplying compressed air into a space between said inner cover and said outer cover.

A method of this invention with which the objects described above can be accomplished is for polishing peripheral edge part of a semiconductor wafer and comprises holding step of holding the semiconductor wafer by a wafer stage by suction and polishing step of polishing the peripheral edge part of the semiconductor wafer supported by the wafer stage by suction by two or more polishing parts. The polishing step comprises moving the wafer stage supporting the semiconductor wafer sequentially to each of the two or more polishing parts and causing each of the polishing parts to polish the peripheral part of the semiconductor wafer.

The method of this invention further comprises dryness preventing step of supplying pure water to the semiconductor wafer supported by the wafer stage while the semiconductor wafer is being transported between the two or more polishing parts.

The two or more polishing parts include a notch polishing part for polishing a notch on the semiconductor wafer and a bevel polishing part for polishing a beveled part of the semiconductor wafer.

Since this invention is constituted as above, the following effects are conducted.

Since a semiconductor wafer is transported between a notch polishing head and a bevel polishing head by simply moving a wafer stage by operation of a stage moving part, not only a notch and a beveled part of a semiconductor wafer can be polished efficiently within a single device, but also the polishing time can be shortened and the space required for the apparatus can be reduced.

A semiconductor wafer can be positioned accurately on a wafer stage by the notch detecting part and the displacement detecting part.

According to this invention, while a semiconductor wafer supported by adsorption on the wafer stage is grasped and lifted up by the chuck hands, this wafer can be easily released from the suction force towards the wafer stage by stopping the operation of the vacuum pump when the wafer has been lifted up just a little (0.5 mm-1.0 mm).

Since an optical sensor continuously detects the outer diameter of the tape (or its remaining amount on the supply roll), the tension in the tape can be maintained in constant.

Components of a driving system (the stage moving part) are covered with the waterproof cover made of an elastic material, and thereby the driving system in the device can be protected against water.

BEST MODE FOR CARRYING OUT THE INVENTION

A device according to this invention is for polishing the peripheral edge part of a semiconductor wafer (inclusive of the notch and the beveled part).

Figure 1A:
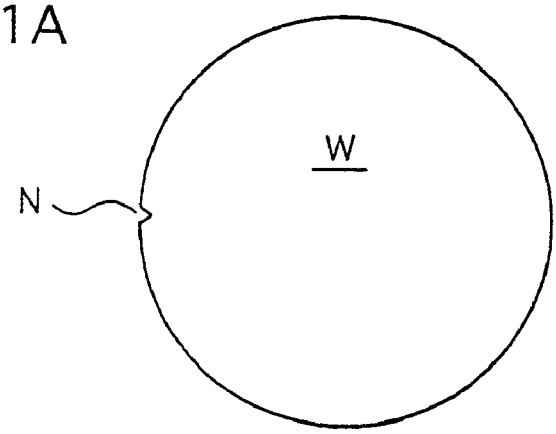
FIG. 1A is a plan view of a semiconductor wafer.

As shown in FIG. 1A, the semiconductor wafer (hereinafter referred to simply as the wafer) W is a thin disk comprising monocrystalline silicon and a notch N is provided to its periphery for indicating its orientation, serving as an a reference for positioning the circularly shaped wafer W inside a semiconductor processing apparatus.

The wafer W may be roughly classified either as a straight type or a round type, depending on its cross-sectional shape. A semiconductor wafer of a straight type has a polygonal sectional shape as shown in FIG. 1B, while a semiconductor wafer of a round type has a curved (semicircular or semi-elliptical) sectional shape as shown in FIG. 1C.

Figure 1B:
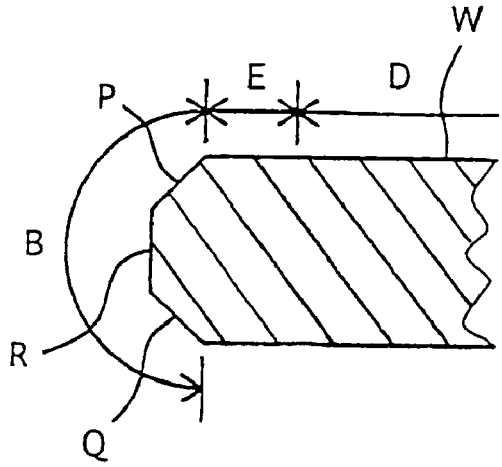
FIGS. 1B and 1C are each a sectional view of its peripheral edge portion.
Figure 1C:
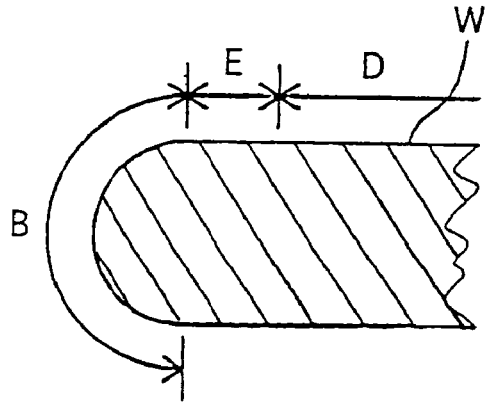

Throughout herein, expression "beveled part" will be used, in the case of a wafer W of a straight type shown in FIG. 1B, to indicate the upper sloped surface P, the lower sloped surface Q and the end surface R (altogether indicated by letter B), and, in the case of a wafer W of a round type shown in FIG. 1C, to indicate the curved surface portion indicated by letter B. Expression "edge" will be used to indicate the surface portion indicated by letter E between the beveled part B and the portion indicated by letter D for forming a semiconductor device.

Figure 2A:
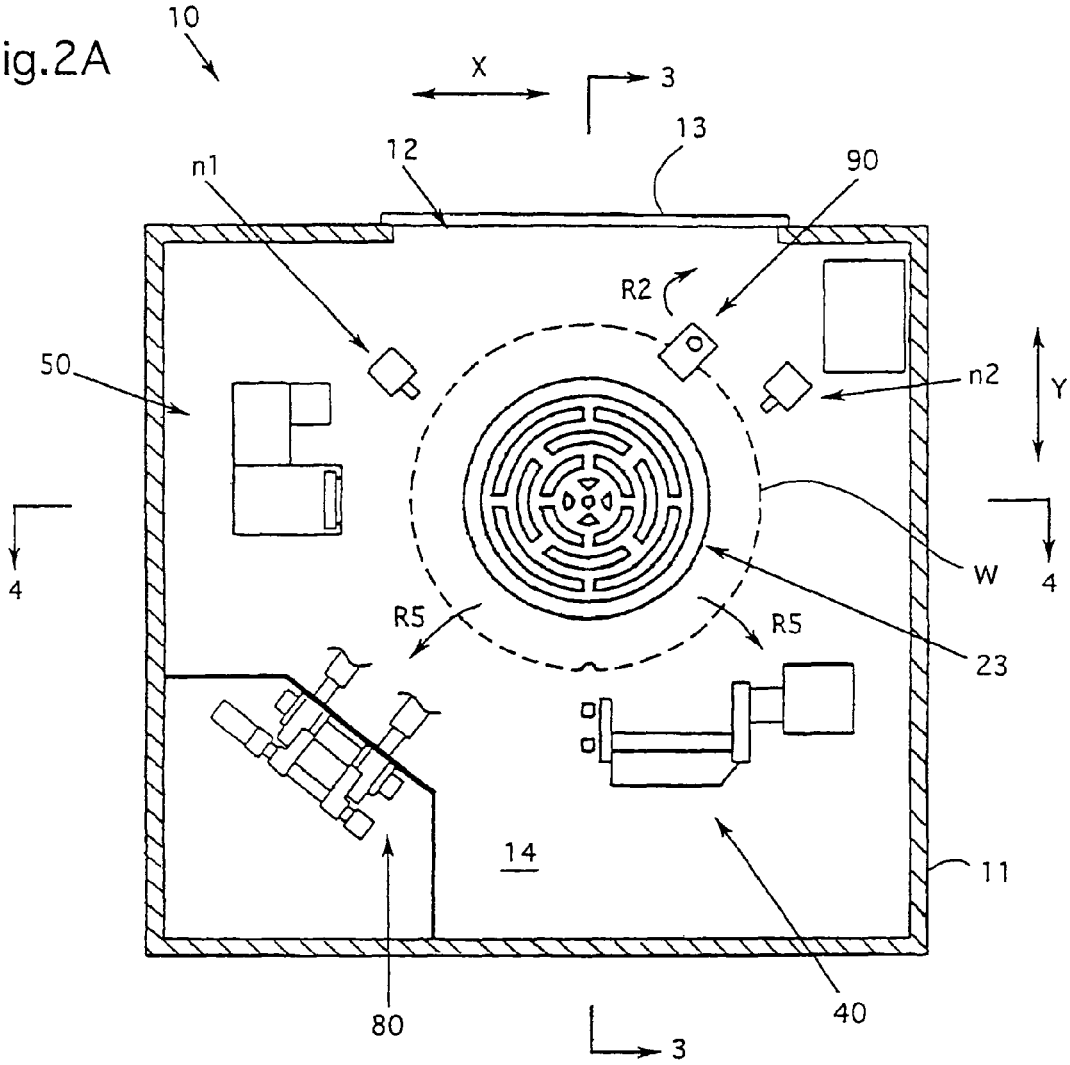
FIGS. 2A and 2B are together referred to as FIG. 2, FIG. 2A being a plan view of a device according to this invention and FIG. 2B showing the reciprocating rotary motion of the semiconductor wafer.
Figure 2B:
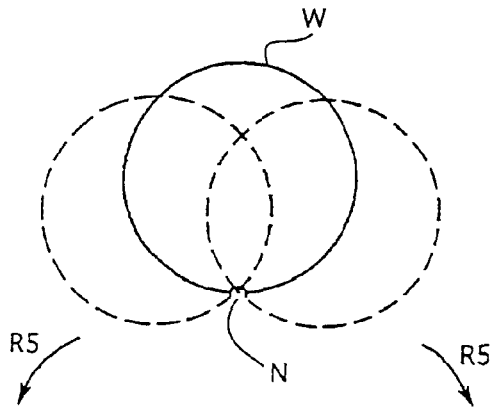
Figure 3:
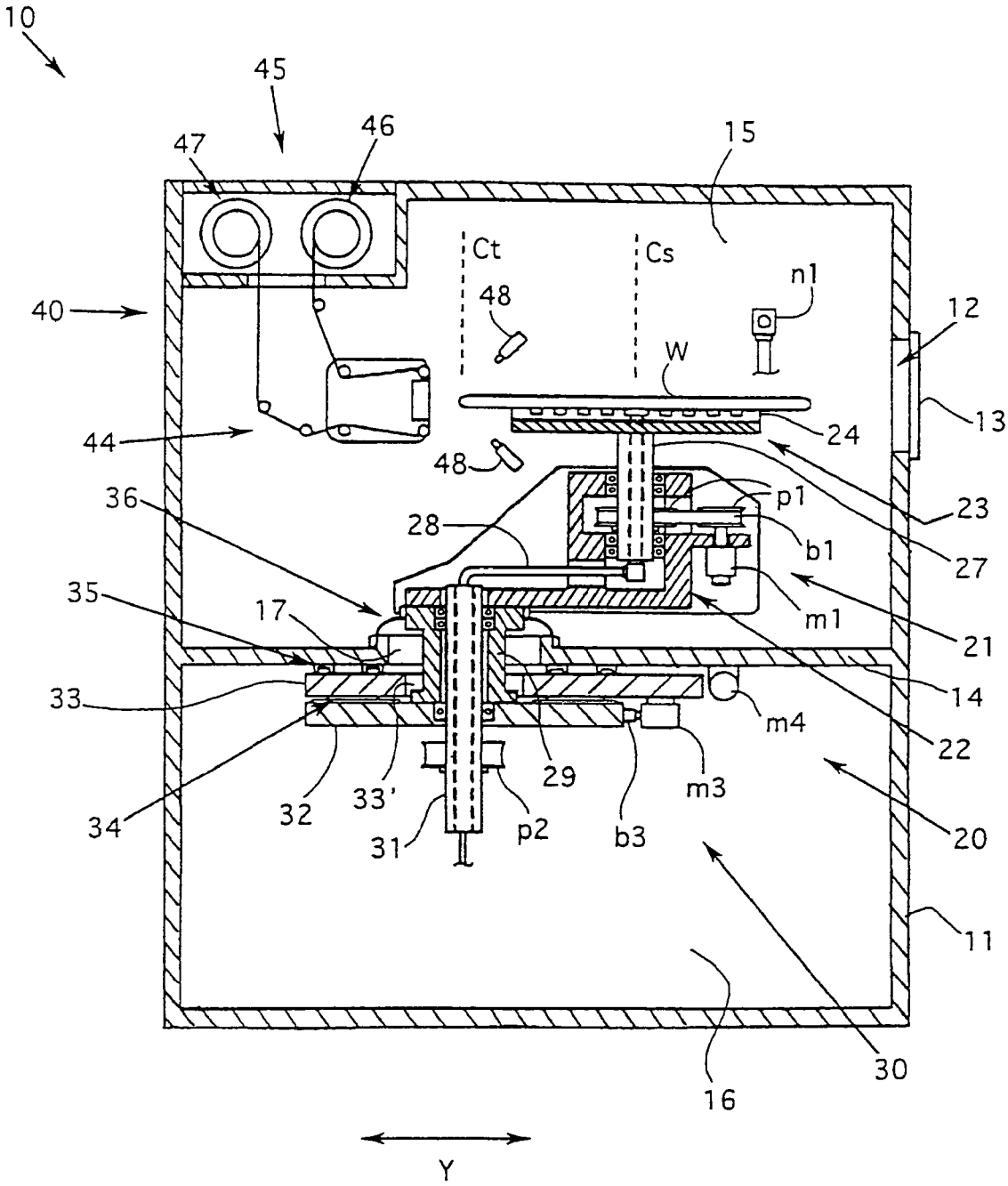
FIG. 3 is a sectional view taken along line 3-3 of FIG. 2A.
Figure 4:
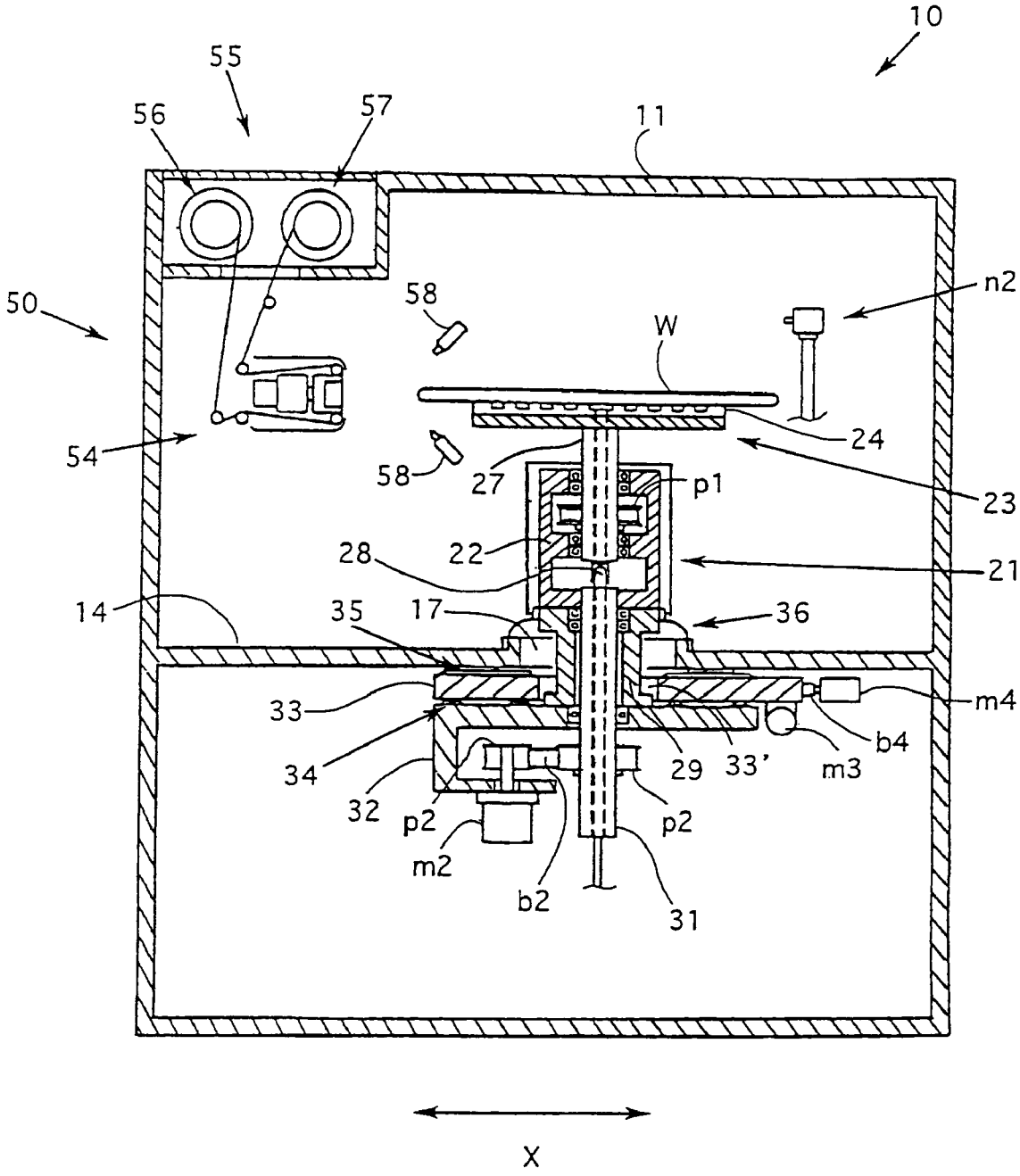
FIG. 4 is a sectional view taken along line 4-4 of FIG. 2A.

FIGS. 2, 3 and 4 show a device 10 according to this invention, comprising a wafer stage unit 20 having a wafer stage 23 for holding a wafer W, a stage moving part 30 for transporting the wafer stage unit 20 parallel to the surface of the wafer stage 23 and two or more polishing parts for polishing the peripheral edge part of the wafer W held by the wafer stage 23. As representative examples of the two or more polishing parts, the device 10 is shown herein as having a notch polishing part 40 for polishing the notch of the wafer W held by the wafer stage 23 and one bevel polishing part 50 for polishing the beveled part of the wafer W held by the wafer stage 23, but the invention does not prevent the device 10 from having more notch polishing parts or bevel polishing parts. If three notch polishing parts and three bevel polishing parts are provided, the first one of each group of three may be used for rough polishing, the second for finishing and the third for cleaning.

There is a housing 11, which is divided into two spaces (an upper chamber 15 and a lower chamber 16) by means of a partition plate 14, the upper chamber 15 containing the wafer stage unit 20, the notch polishing part 40 and the bevel polishing part 50 and the lower chamber 16 containing the stage moving part 30.

The housing 11 is provided with an opening 12 on the side surface of its upper chamber 15. This opening 12 can be opened and closed by means of a shutter 13 adapted to be driven by a cylinder (not shown). The wafer W is brought into and taken out of the housing 11 through this opening 12. A wafer transporting part of a known kind such as a robot hand (as shown by numeral 13' in FIGS. 5A and 5B) may be used for transporting the wafer W into and out of the housing 11. The shutter 13 serves to completely screen the interior of the housing 11 from the exterior such that the degree of cleanliness and the airtight condition of the interior of the housing 11 can be maintained and that both the contamination of the wafer from the exterior of the housing 11 and the contamination of the exterior of the housing 11 due to the polishing liquid and particles that scatter can be prevented.

The device 10 of this invention further comprises a wafer chuck assembly 80 for placing the wafer W brought inside the housing 11 onto the wafer stage 23 and picking up the wafer W placed on the wafer stage 23 away from the wafer stage 23.

Figure 5A:
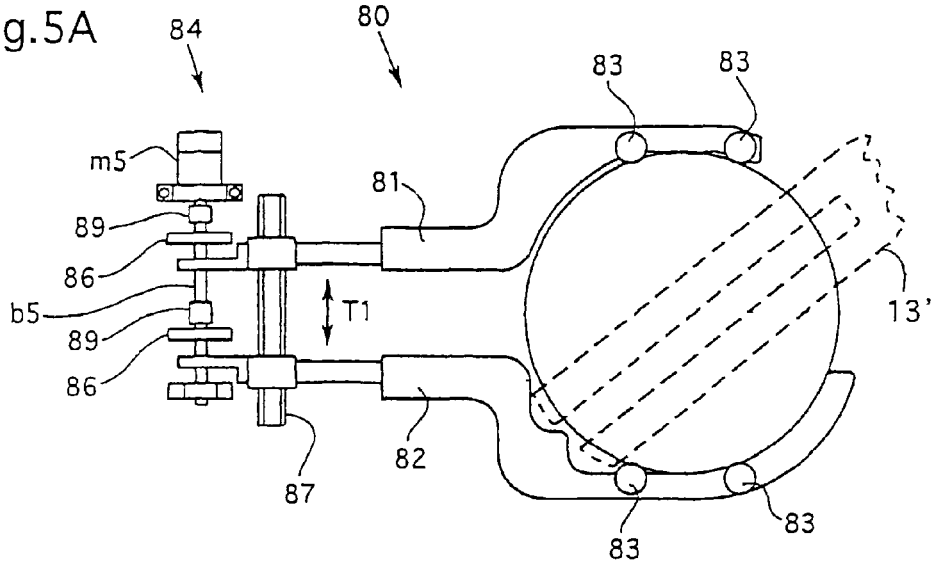
FIGS. 5A and 5B are respectively a plan view of and a side view of the wafer chuck assembly.

As shown in FIG. 5A, the wafer chuck assembly 80 comprises a first chuck hand 81 having two or more knobs 83, a second chuck hand 82 having two or more knobs 83, a chuck hand opening part 84 for opening and closing these first and second chuck hands 81 and 82 parallel to the surface of the wafer W held by the wafer stage 23 (in the direction of arrow T1) and a chuck moving part 85 for reciprocatingly moving the first and second chuck hands 81 and 82 perpendicularly to the surface of the wafer W held by the wafer stage 23 (in the direction of arrow T2) such that, as the first and second chuck hands 81 and 82 are closed, the knobs 83 on the first and second chuck hands 81 and 82 will come to contact the periphery of the wafer W and the wafer W is thus grasped between the first and second chuck hands 81 and 82.

As shown in FIG. 5A, the chuck hand opening part 84 comprises a ball screw b5 which engages the first and second chuck hands 81 and 82, a servo motor m5 for driving the ball screw b5 and a linear guide 87 which extends in the direction of arrow T1 and penetrates the first and second chuck hands 81 and 82. The ball screw b5 is connected to a guide 86 and a coupling 89 such that, as the servo motor m5 is operated, the first and second chuck hands 81 and 82 move in the direction of arrow T1 to open or close. The center of the wafer W is preferably arranged so as to be above the center of the wafer stage 23 (or above the rotary shaft Cs of the wafer stage 23 to be described below) as the first and second chuck hands 81 and 82 come to grasp the wafer W in between.

Figure 5B:
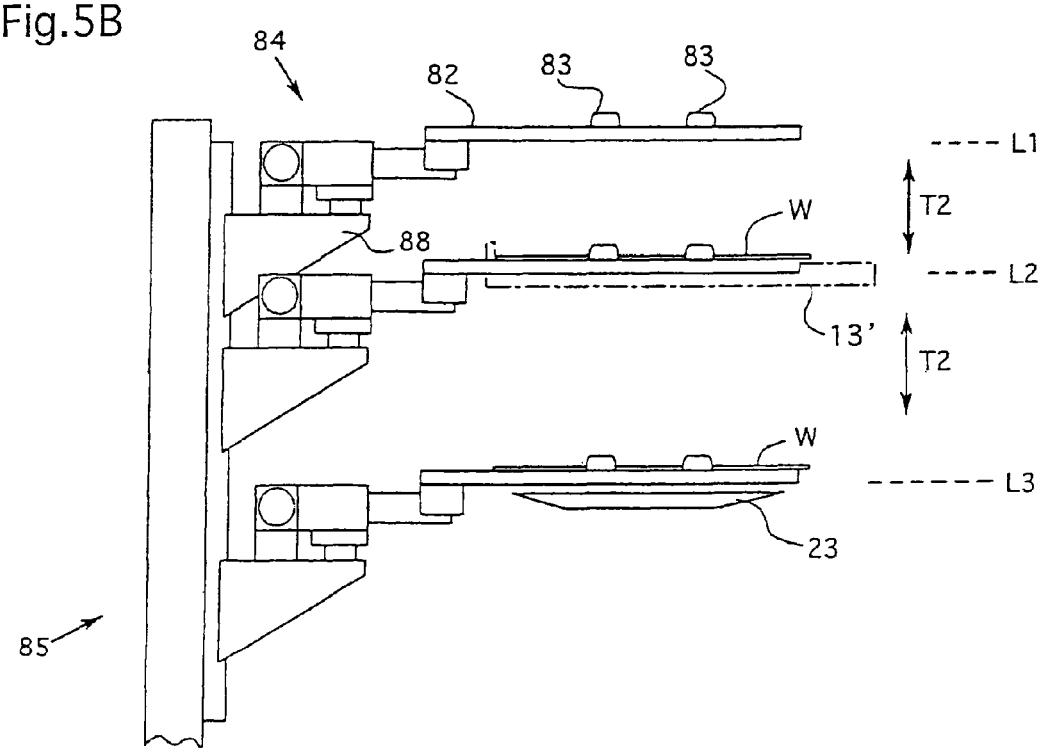

As shown in FIG. 5B, the chuck moving part 85 serves to engage an elevator table 88 attached to the first and second chuck hands 81 and 82 with a ball screw (not shown) and to drive this ball screw by means of a servo motor (not shown) so as to move the first and second chuck hands 81 and 82 perpendicularly to the surface of the wafer stage 23 (in the direction of arrow T2). In FIG. 5B, L1 indicates a retracted position, L2 indicates a wafer delivery position where the wafer W on the robot hand 13' is grasped by the first and second chuck hands 81 and 82 or the wafer W is loaded onto the robot hand 13', and L3 indicates a wafer setting position where the wafer W is set on the wafer stage 23 or the wafer W set on the wafer stage 23 is grasped by the first and second chuck hands 81 and 82.

As shown in FIGS. 2, 3 and 4, the wafer stage unit 20 further comprises a stage rotating part for rotating the wafer stage 23 and a reciprocating motion part for causing the wafer stage 23 to undergo a rotary reciprocating motion with respect to the notch of the wafer W held by the wafer stage 23 in the same plane as the surface of the wafer W held by the wafer stage 23 (in the direction of arrow R5).

As shown in FIGS. 2-4 and 9, the wafer stage 23 has a flat surface provided with one or more suction holes 25 (only one such suction hole in the illustrated example) connected to a vacuum pump (not shown). An elastic pad 24 having a specified height (thickness) is adhesively attached to this surface so as not to block the suction hole 25, and the wafer W is placed on this pad 24. The suction hole 25 is connected to an external vacuum pump (not shown) through a hollow shaft 27, a pipe which is rotatably attached to the lower end of this hollow shaft 27 and another hollow shaft 31.

Grooves 26 and 26' connected to the suction hole 25 are formed on the upper surface of the pad 24. Preferably, the pad 24 is formed with concentric circular grooves 26 and a plurality of radial grooves 26' that connect the circular grooves 26 and these grooves 26 and 26' are connected to the vacuum pump referred to above. As the wafer W is placed on the pad 24, these grooves 26 and 26' are sealed by the lower surface of the wafer W in an airtight manner. Thus, if the vacuum pump is activated, the wafer comes to be supported from its bottom side by the pad 24 without deforming (bending).

The wafer W, thus clasped by the first and second chuck hands 81 and 82, is placed on the pad 24 on the wafer stage 23 by the chuck moving part 85. As these chuck hands 81 and 82 are opened by the chuck hand opening part 84, the vacuum pump is simultaneously activated and the pressure in the space on the backside of the wafer W (or the interior of the grooves 26 and 26' formed on the upper surface of the pad 24) is reduced, causing it to be pressed towards the pad 24 and to sink somewhat into it. This is how the wafer W is securely adsorbed to the wafer stage 23 and supported by it.

The wafer W thus adsorbed to and supported by the wafer stage 23 is grasped by the first and second chuck hands 81 and 82 and then lifted up by the chuck moving part 85. When it has floated up a little (say, 0.5 mm-1.0 mm), the vacuum pump is stopped and the vacuum suction is stopped. In this manner, there is no instantaneously large force applied to the wafer W when it is removed from the condition of being adsorbed to the wafer stage 23. In other words, the wafer W can be removed from the wafer stage 23 without deforming it or damaging it.

As shown in FIGS. 3 and 4, the stage rotating part comprises a shaft 27 that is attached coaxially to the rotary shaft Cs on the backside of the wafer stage 23 and a motor m1 connected to this shaft 27 through a pulley p1 and a belt b1. The shaft 27 is rotatably attached through a bearing to a support member 22 of a unit main body 21. The motor m1 is affixed to this supporting member 22. As the motor m1 is activated, the wafer stage 23 rotates around its center, that is, around its rotary shaft Cs.

The reciprocating motion part is for causing the wafer stage 23 to undergo a rotary reciprocating motion in the same plane as the surface of the wafer stage 23 and comprises a shaft 31 which penetrates an opening 17 through the partition plate 14 of the housing 11 at a position offset from the rotary shaft Cs of the wafer stage 23 approximately by the length of the radius of the wafer W and is affixed to the lower surface of the support member 22 of the unit main body 21 and a motor m2 connected to this shaft 31 through a pulley p2 and a belt b2. The shaft 31 is rotatably attached to a hollow cylindrical shaft table 29 through a bearing. The lower surface of this shaft table 29 is affixed to a support plate 32 below the partition plate 14 of the housing 11, and the upper surface of the shaft table 29 contacts the lower surface of the unit main body 21 to support it. The motor m2 is fastened to this support plate 32.

As this motor m2 is activated, the wafer stage unit 20 undergoes a rotary reciprocating motion around a rotary shaft Ct within the same plane as the surface of the wafer stage 23 (in the direction shown by arrow R5 in FIGS. 2A and 2B). Preferably, the reciprocating motion part causes the wafer stage 23 supporting the wafer W to undergo a rotary reciprocating motion with respect to the notch of the wafer W within the same plane as the surface of the wafer stage 23.

As shown in FIGS. 3 and 4, the stage moving part 30 comprises the support plate 32 fastening the shaft table 29 of the reciprocating motion part and a parallel motion mechanism for moving this support plate 32 parallel to the surface of the wafer stage 23.

As shown, the parallel motion mechanism is comprised of a mobile plate 33 which is positioned between the partition plate 14 of the housing 11 and the support plate 32 and is attached to the partition plate 14 through a linear guide 35 so as to be movable in a "first direction" (indicated by arrow X in FIGS. 2A and 4), a ball screw b4 connected to this mobile plate 33 for moving the mobile plate 33 in the direction of arrow X, and a motor m4 for driving this ball screw b4. The mobile plate 33 has an opening 33' through which the shaft table 29 passes. The support plate 32 is attached to the lower surface of this mobile plate 33 through a linear guide 34 so as to be movable perpendicularly to the first direction X (that is, in the direction indicated by arrow Y in FIGS. 2 and 3). A ball screw b3 is connected to the support plate 32 for moving the support plate 32 in the direction of arrow Y and this ball screw b3 is driven by a motor m3 affixed to the mobile plate 33. Thus, as the motor m4 affixed to the lower surface of the partition plate 14 is driven, the ball screw b4 connected to the mobile plate 33 rotates and the mobile plate 33 moves in the direction of arrow Y, and as the motor m3 affixed to the mobile plate 33 is driven, the ball screw b3 connected to the support plate 32 rotates and the support plate 32 moves in the direction of arrow Y with respect to the mobile plate 33. Since the ranges of movement of the wafer stage unit 20 in the directions of arrows X and Y are determined by the size of the opening 17 provided to the partition plate 14 and the size of the opening 33' provided to the mobile plate 33, the sizes of these openings 17 and 33' may be increased at the time of designing the device 10 if larger ranges of movement are desired for the wafer stage unit 20.

Figure 10:
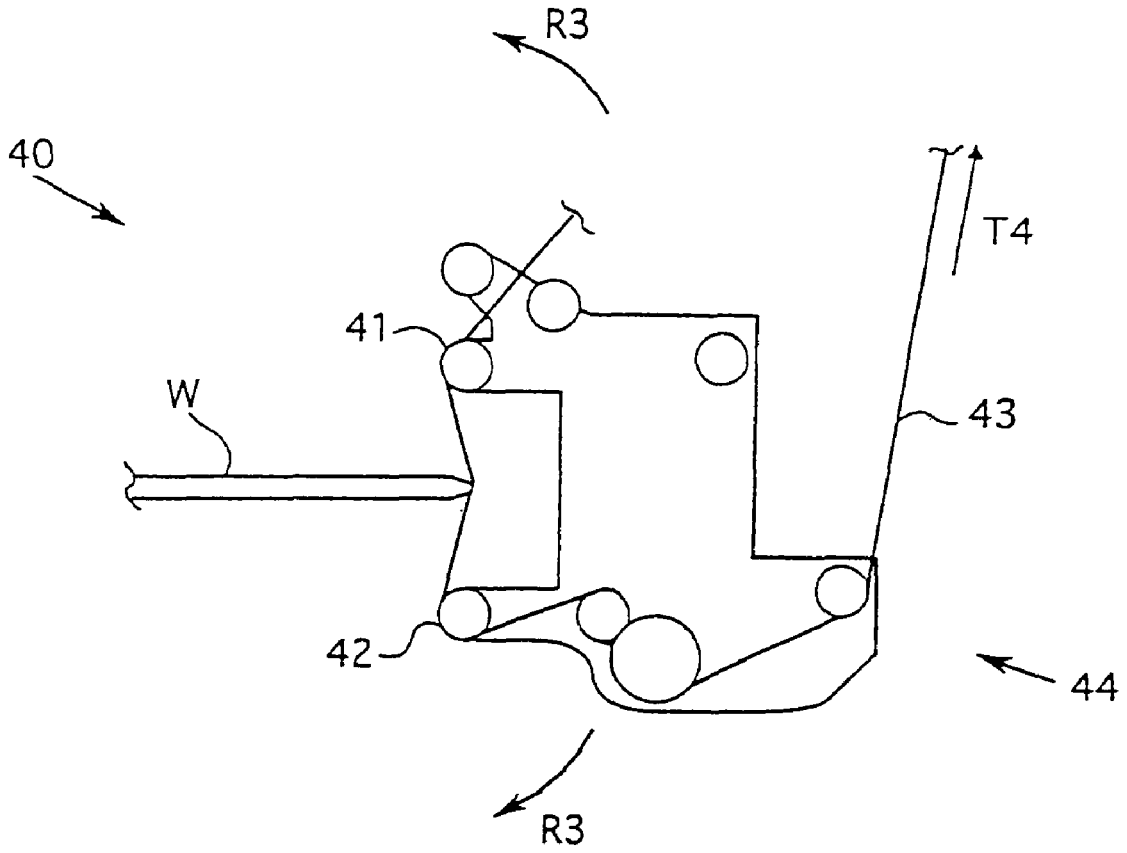
FIG. 10 is a side view of the notch polishing head.

As shown in FIGS. 3 and 10, the notch polishing part 40 is comprised of a notch polishing head 44 for pressing the notch of the wafer W (hereinafter referred to simply as the notch) to a tape 43 and a tape supplying part 45 for supplying the tape 43 to the notch polishing head 44 and winding up the supplied tape 43. The notch polishing head 44 has a pair (first and second) of rollers 41 and 42 attached mutually parallel to each other with an interval in between such that the notch is pressed against the tape 43 passing between these rollers 41 and 42. The tape supplying part 45 is comprised of a supply roll 46 having the tape 43 wound around it, a take-up roller 47 for taking up the tape 43 from the supply roll 46 having the tape 43 from the supply roll 46 through the first and second rollers 41 and 42 and a roller driving part (not shown) for driving the take-up roller 47 for taking up the tape 43.

The notch polishing part 40 may also include a mechanism for causing the notch polishing head 44 to undergo a reciprocating motion perpendicularly to the surface of the wafer W while the tape 43 is pressed against the notch. Although not shown, this mechanism may comprise a linear guide extending perpendicularly to the surface of the wafer stage 23 and a crank shaft mechanism for moving the notch polishing head 44 reciprocatingly by means of a motor.

The notch polishing part 40 may further include another mechanism for causing the notch polishing head 44 to undergo a rotary reciprocating motion around the notch (in the direction shown by arrow R3 in FIG. 10) while the tape 43 is pressed against the notch such that the front and back surface sides of the notch can be polished. Although not shown, this mechanism may comprise a shaft extending perpendicularly to the direction of motion of the tape 43 and a motor for rotating this shaft. This shaft is set at a position where the tape 43 is pressed against the notch and is connected to the notch polishing head 44, becoming its axis of rotation. As the motor is driven to rotate this shaft, the notch polishing head 44 undergoes a rotary reciprocating motion in the direction of arrow R3 around the notch while the tape 43 is pressed against the notch such that both its front and back surface sides are polished.

The notch polishing part 40 may still further be provided with a nozzle 48 for supplying the notch with a polishing liquid of a slurry form having abrading particles dispersed in water or a water-based reactive liquid as well as cooling water.

The tape 43 may be of a woven or non-woven cloth or a foamed material. A base film in the form of a tape made of a plastic material or a tape having a polishing layer with abrading particles fastened by means of a resin binder may be used. Examples of abrading particles include diamond particles with average diameter in the range of 0.1 μm-5.0 μm and SiC particles with average diameter in the range of 0.1 μm-5.0 μm. Polyester and polyurethane type resin binders can be used. Examples of base film include films of a flexible material such as polyester, polyurethane and polyethylene terephthalate.

It is preferable to use a tape comprising a polishing layer having abrading particles affixed by a resin binder together with a polishing liquid having abrading particles dispersed in water and/or cooling water. This is because the polishing can be effected without using any water-based reactive liquid and hence the contamination of the water and the interior of the housing 11 (that is, the contamination of each constituent component set inside the housing 11) can be prevented more dependably.

Figure 8:
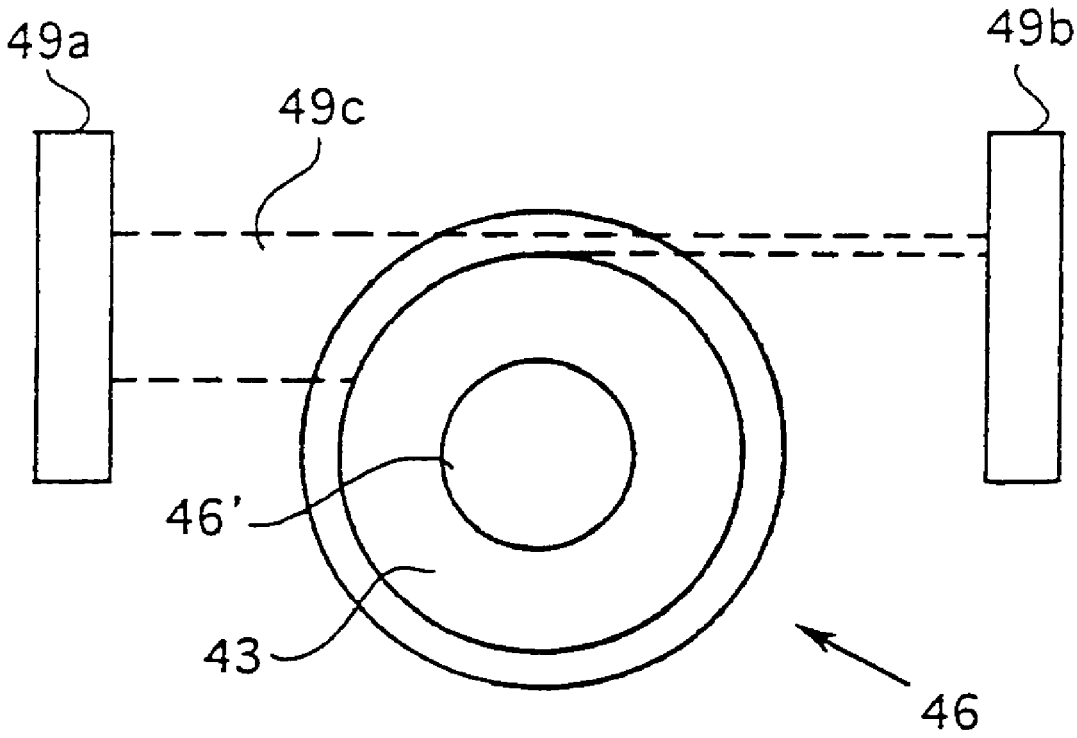
FIG. 8 is a schematic view of the diameter detecting part for detecting the outer diameter of the tape.
Figure 9:
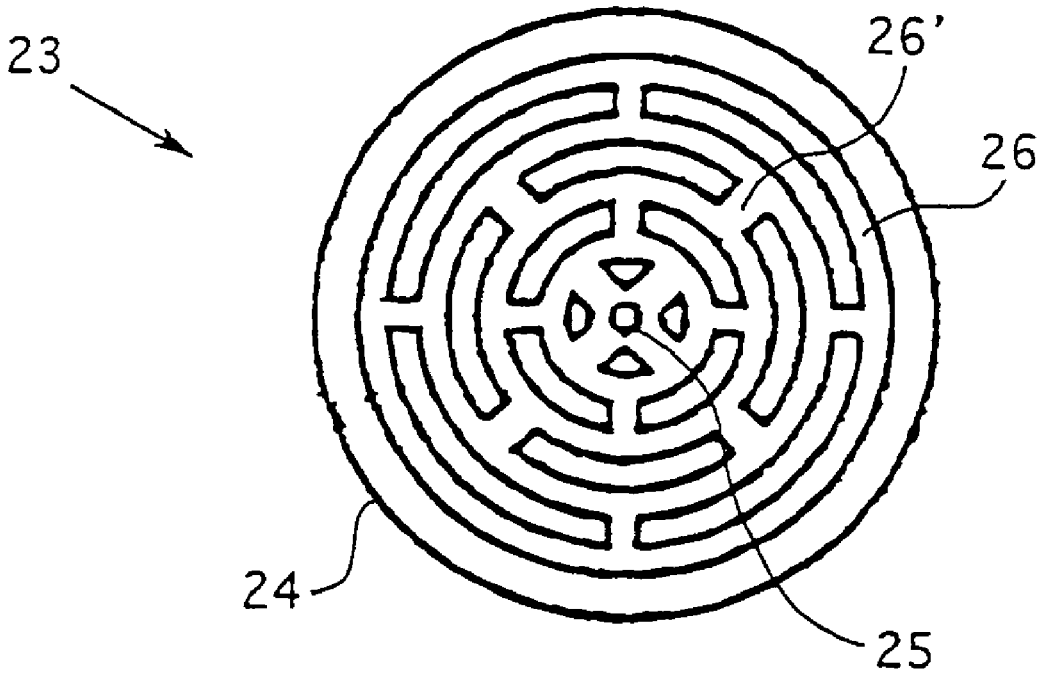
FIG. 9 is a plan view of the wafer stage.

According to practical examples, the width of the tape 43 is within the range of 1 mm-10 mm, the length of the tape 43 is several tens of meters and the tape 43 is wound around a cylindrical core material (shown at 46' in FIG. 8).

The polishing of the notch is carried out by moving the wafer held by the wafer stage 23 parallel to the surface of the wafer stage 23 by the stage moving part 30 so as to press the notch to the tape 43 of the notch polishing part 40 and causing the wafer stage 23 to undergo a rotary reciprocating motion around the notch (in the direction shown by arrow R5 in FIGS. 2A and 2B) within the same plane as the surface of the wafer W held by the wafer stage 23 by the reciprocating motion part. In the above, the notch polishing head 44 may be caused to undergo a reciprocating motion perpendicularly to the surface of the wafer W and/or a rotary reciprocating motion around the notch (in the direction shown by arrow R3 in FIG. 10) while the tape 43 is pressed against the notch.

Although an example was described above wherein the notch is polished by using a tape, this is not intended to limit the scope of the invention. The notch may be polished instead by using a disk-shaped pad of a known kind with the outer periphery not having the same shape as that of the notch.

As shown in FIG. 8, the notch polishing head 40 may further comprise a diameter detecting part for detecting the outer diameter of the tape 43 or the remaining amount of the tape 43 still on the core material 46' of the tape supply roll 46. As shown, this detecting part comprises an optical sensor having a light emitter 49*a* and a light receiver 49*b*, the supply roll 46 being preferably disposed between the light emitter 49*a* and the light receiver 49*b*. The outer diameter of the tape 43 still wound around the supply roll 46 can be detected by the quantity of light 49*c* received by the light receiver 49*b*. The outer diameter of the tape 43 thus detected is transmitted to a control device (not shown) for a motor for supplying the tape 43 from the supply roll 46 such that the torque value of the motor will vary smoothly and the tension in the tape 43 will remain constant.

Figure 11:
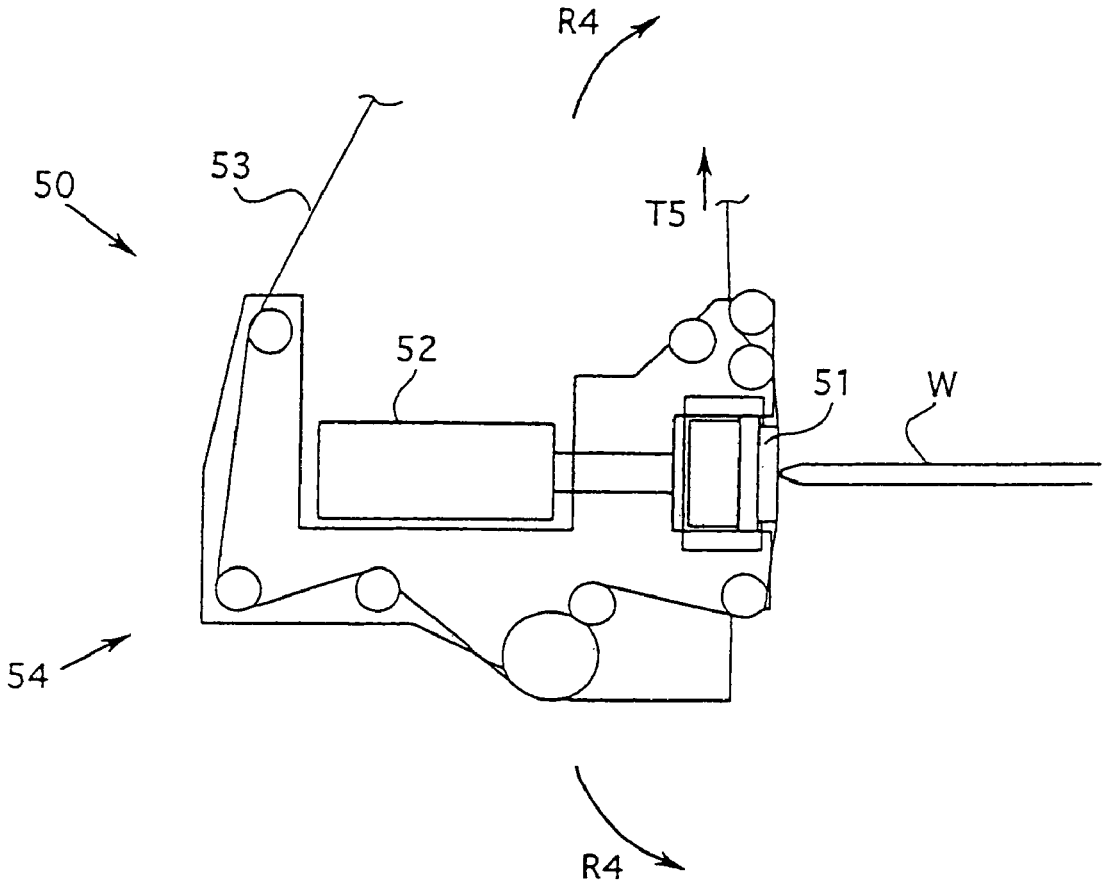
FIG. 11 is a side view of the bevel polishing head.

As shown in FIGS. 4 and 11, the bevel polishing part 50 comprises a bevel polishing head 54 having a cylinder 52 with a contact pad 51 attached to its end and a tape supplying part 55 for supplying a tape 53 to the bevel polishing head 54 and taking up the supplied tape 53.

The tape supplying part 55 comprises a supply roll 56, a take-up roller 57 for winding up the tape 53 from the supply roll 56 through the contact pad 51 and a driving part (not shown) for driving the take-up roller 57 for winding up the tape 53. The tape 53 passing over the contact pad 51 is pressed against the beveled part of the wafer W through the contact pad 51 and the beveled part is thereby polished.

The bevel polishing part 50 may also include a mechanism for causing the bevel polishing head 54 to undergo a rotary reciprocating motion around a beveled part perpendicularly to the surface of the wafer W (in the direction shown by arrow R4 in FIG. 11). This mechanism may comprise, although not shown, a shaft extending perpendicularly to the direction of motion of the tape 53 and a motor for rotating this shaft. This shaft is set at a position where the tape 53 is pressed against a beveled part of the wafer W and is connected to the bevel polishing head 54, becoming its axis of rotation. As the motor is driven, the bevel polishing head 54 undergoes a rotary reciprocating motion around the beveled part in the direction of arrow R4 while the tape 53 is pressed against the beveled part such that the front and back surface sides of the beveled part of the wafer W are polished.

The bevel polishing part 50 may further be provided with a nozzle 58 for supplying the beveled part with a polishing liquid of a slurry form having abrading particles dispersed in water or a water-based reactive liquid as well as cooling water.

The tape 53 may be a woven or non-woven cloth or a foamed material. A base film in the form of a tape made of a plastic material or a tape having a polishing layer with abrading particles fastened by means of a resin binder may be used. Examples of abrading particles include diamond particles with average diameter in the range of 0.1 μm-5.0 μm and SiC particles with average diameter in the range of 0.1 μm-5.0 μm. Polyester and polyurethane type resin binders can be used. Examples of base film include films of a flexible material such as polyester, polyurethane and polyethylene terephthalate.

It is preferable to use a tape comprising a polishing layer having abrading particles affixed by a resin binder together with a polishing liquid having abrading particles dispersed in water and/or cooling water. This is because the polishing can be effected without using any water-based reactive liquid and hence the contamination of the water and the interior of the housing 11 (that is, the contamination of each constituent component set inside the housing 11) can be prevented more dependably.

According to practical examples, the width of the tape 53 is within the range of 1 mm-10 mm, the length of the tape 43 is several tens of meters and the tape 53 is wound around a cylindrical core material.

If a tape with a polishing layer having abrading particles with average diameter less than 2.0 μm is used to polish the beveled part of a wafer W, it is possible to adjust the diameter of the wafer W to a specified length. If a tape with a polishing layer having abrading particles with average diameter 2.0 μm or less is used, a finishing work can be carried out on the beveled part of the wafer W.

If the average diameter of abrading particles affixed to the polishing layer is thus selected and the bevel polishing head 54 is caused to undergo a rotary reciprocating motion around the beveled part in the direction of arrow R4 during the polishing process, it is possible to form the upper and lower sloped surfaces of the wafer W (indicated by P and Q in FIG. 1B) at any specified angle with a finishing work.

Figure 6A:
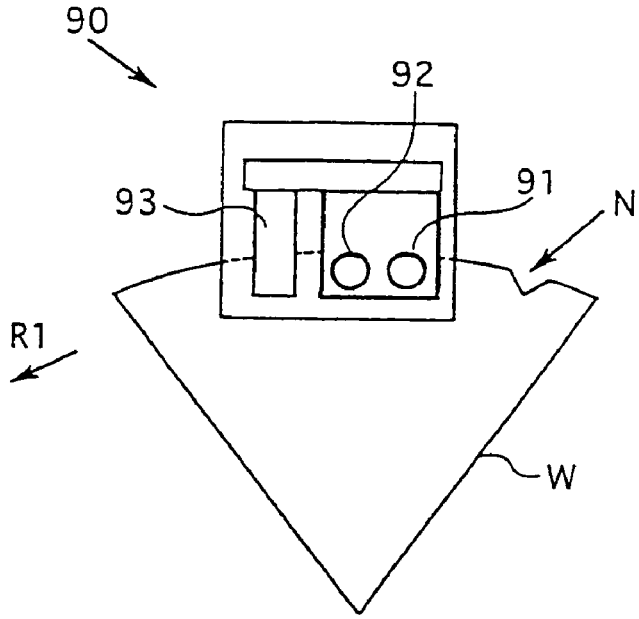
FIGS. 6A and 6B are each a plan view of the sensor assembly.

The beveled part of the wafer W is polished by moving the wafer W held by the wafer stage 23 parallel to the surface of the wafer stage 23 by using the stage moving part 30, pressing the beveled part of the wafer W against the tape and rotating the wafer stage 23 in the direction of arrow R1 shown in FIG. 6A by using the stage rotating part. Although an example using the tape 53 was described above, this is not intended to limit the scope of the invention. A lapping plate with a pad attached to the surface or a rotary cylindrical grinding stone of a known type may be used to polish the beveled part.

The bevel polishing part 50, like the notch polishing part 40, may be provided with a diameter detecting part for detecting the outer diameter of the tape 54 wound around the supply roll 56. This detecting part is like that for the notch polishing part 40, comprising an optical sensor having a light emitter and a light receiver and having the supply roll disposed between the light emitter and the light receiver. The quantity of light received by the light receiver is measured and the outer diameter of the tape 53 remaining wound around the supply roll 56 is thereby determined. The outer diameter of the tape 53 thus detected is transmitted to a controller for a motor for supplying the tape 53 from the supply roll 56 such that the torque value of the motor will vary smoothly and the tension in the tape 53 will remain constant.

Figure 12A:
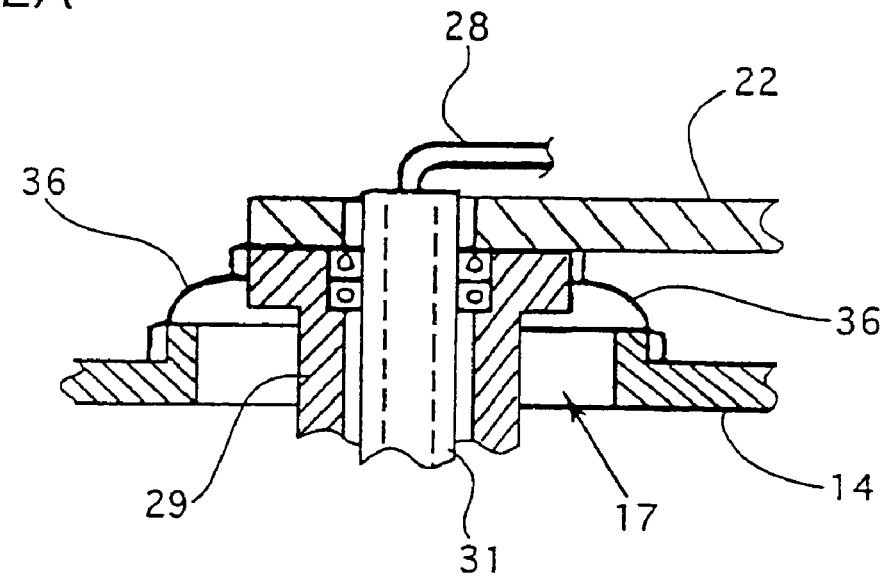
FIG. 12A is a sectional view of a waterproofing cover of a single structure.
Figure 12B:
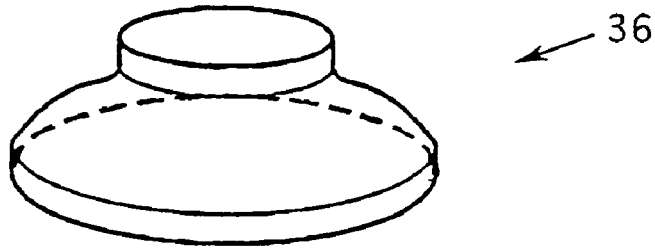
FIG. 12B is its diagonal view.
Figure 12C:
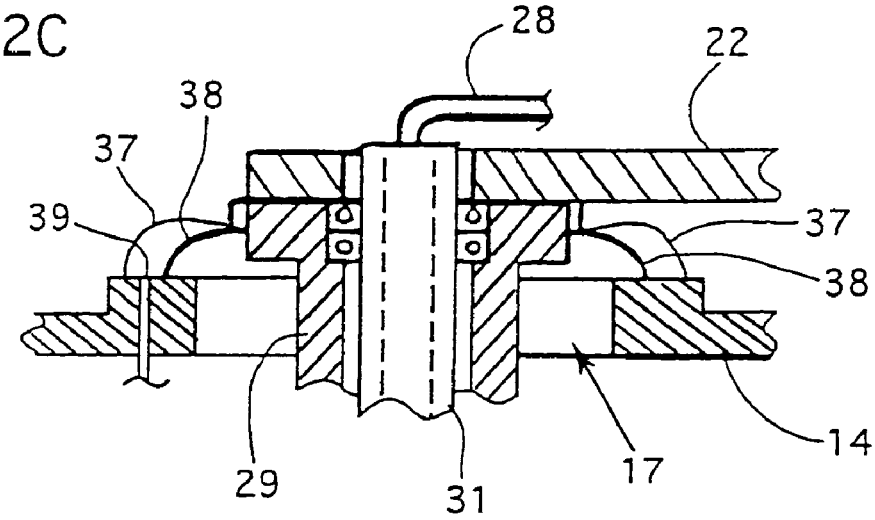
FIG. 12C is a sectional view of a waterproofing cover of a double structure.

As shown in FIGS. 12A, 12B and 12C, the device 10 according to this invention further includes a waterproofing structure for waterproofing the lower chamber 16 of the housing 11 (and in particular the parallel motion mechanism contained therein). As shown in FIG. 12A, the waterproofing structure comprises a hollow semispherical waterproof cover 36 (such as shown in FIG. 12B) having its upper part affixed to the upper part of the shaft table 29 in a liquid-tight manner and its bottom part affixed to the periphery of the opening 17 provided to the partition plate 14 in a liquid-tight manner. Since the shaft table 29 moves both in the directions of arrows X and Y, the waterproof cover 36 is made of an elastic material in order to prevent damage by the motion of the shaft table 29.

The waterproof cover 36 may be a single structure as shown in FIG. 12A or a double structure as shown in FIG. 12C. If it is a double structure as shown in FIG. 12C, the partition plate 14 may be provided with an opening 39 connected to an external air pump (not shown) near the opening 17 for blowing in compressed air into the space between the outer cover 37 and the inner cover 38 of the waterproof cover 36 such that the outer cover 37 is expanded and water drops gathered on its surface can be scattered away.

Flexible sheets not permeable to liquids made, for example, of a plastic material are used as the waterproof cover 36 (or outer and inner covers 37 and 38). Flexible sheets made of a foamed material may preferably be used.

Figure 6B:
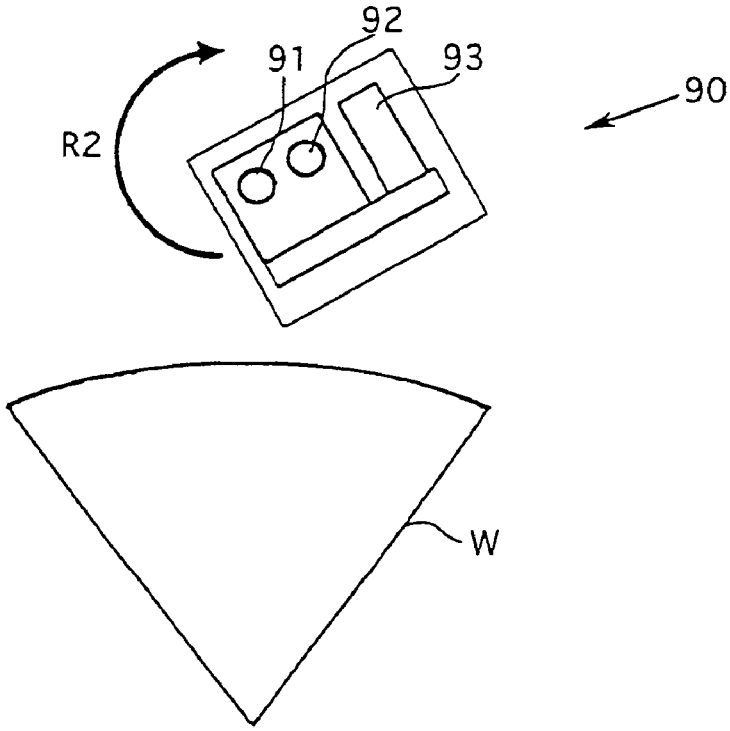

As shown in FIGS. 6A and 6B, the device 10 of this invention further comprises a sensor assembly 90 including a notch position detecting part for detecting the position of the notch on the wafer W held by the wafer stage 23.

The notch position detecting part comprises at least one optical sensor (three sensors 91, 92 and 93 being shown). Each optical sensor may be structured with a light emitter and a light receiver arranged such that the notch N on the watch W being held by the wafer stage 23 passes between them. As the wafer W rotates (as shown by arrow R1), light from the light emitter is received by the light receiver only when the notch N is directly below the light emitter. This is how the position of the notch N is detected.

Alternatively, an optical sensor of the straight light regression type may be used. An optical sensor of this type is a laser sensor having a light emitter and a light receiver disposed on the same side and a reflector disposed opposite to them for reflecting the light from the light emitter. In this case, the laser light from the light emitter is reflected by the reflector and detected by the light receiver only when the notch N on the wafer W is passing directly below the light emitter and this is how the position of the notch N is detected.

According to this invention, the rotary motion of the wafer stage 23 is stopped when the position of the notch N is detected as explained above such that the notch N will face the tape of the notch polishing part.

According to the illustrated example, the notch detecting part is provided with three optical sensors 91, 92 and 93. When the wafer stage 23 holding the wafer W is rotating with a rotary speed within a first range (such as 12 rpm or slower and 4 rpm or faster), it is the first optical sensor 91 that detects the position of the notch N. If the wafer stage 23 is rotating at a lower rotary speed within a second range (such as less than 4 rpm and 1 rpm or faster), it is the second optical sensor 92 that detects the notch position. If the wafer stage 23 is rotating at a still lower rotary speed within a third range (such as less than 1 rpm), it is the third optical sensor 93 that detects the notch position.

Figure 14A:
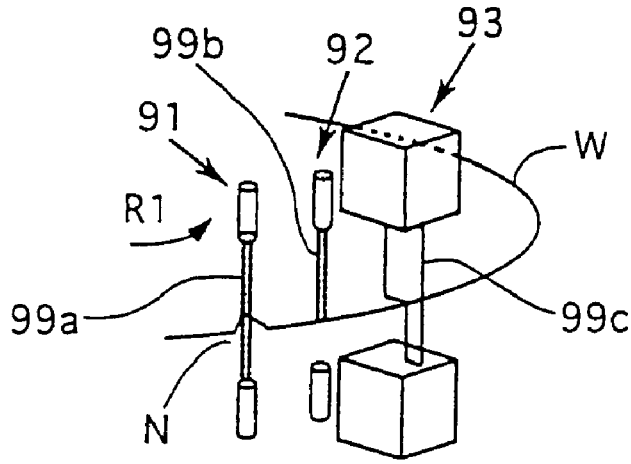
FIGS. 14A, 14B and 14C are each a schematic diagonal view of the notch on the wafer passing below the light emitter of an optical sensor.

FIG. 14A shows the first optical sensor 91 detecting the notch N passing directly below its light emitter, as the wafer stage 23 is rotating at a rotary speed within the aforementioned first range. At this moment, light 99*b* from the light emitter of the second optical sensor 92 and the light 99*c* from the light emitter of the third optical sensor 93 are screened by the periphery of the wafer W.

Figure 14B:
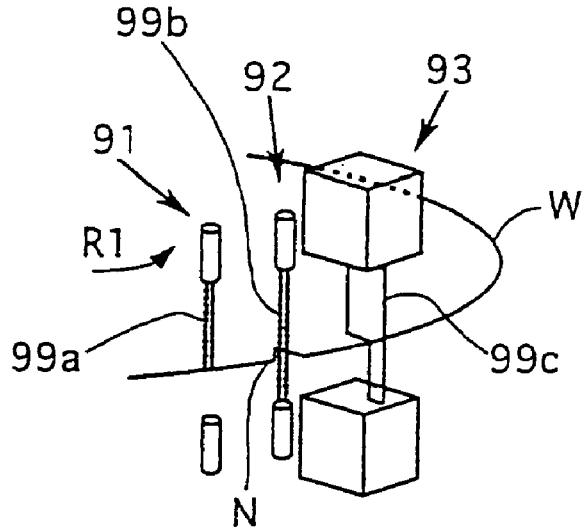

FIG. 14B shows a moment when the wafer stage 23 is rotating at a rotary speed within the second range and as the notch N is passing directly below the light emitter of the second optical sensor 92 and the notch N is being detected by the second optical sensor 92. The light 99*a* from the light emitter of the first optical sensor 91 and the light 99*c* from the light emitter of the third optical sensor 93 are screened by the periphery of the wafer W.

Figure 14C:
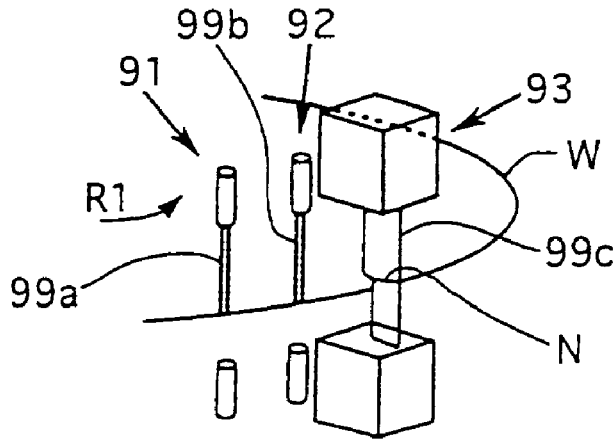

Next, FIG. 14C shows a moment when the wafer stage 23 is rotating at a rotary speed within the third range and as the notch N is passing directly below the light emitter of the third optical sensor 93 and as the notch N is being detected by the third optical sensor 93. The light 99*a* from the light emitter of the first optical sensor 91 and the light 99*c* from the light emitter of the second optical sensor 92 are screened by the periphery of the wafer W.

In summary, as the wafer wage 23 decelerates until it stops, the position of the notch N is detected sequentially by the first, second and third optical sensors 91, 92 and 93 and in a stepwise manner. The third optical sensor 93 is adapted to detect the position of the deepest part of the notch N and hence to detect the position of the notch N most accurately within ±0.1°. Since the position of the notch N is detected merely while the wafer W is rotationally decelerating in the same direction, the detection can be made in a short measuring time.

The sensor assembly 90 is provided with a displacement detecting part for detecting the displacement of the wafer W in its radial direction as being held by the wafer stage 23. Such a displacement may be a result of the wears on the knobs 83 on the first and second chuck hands 81 and 82.

Figure 13A:
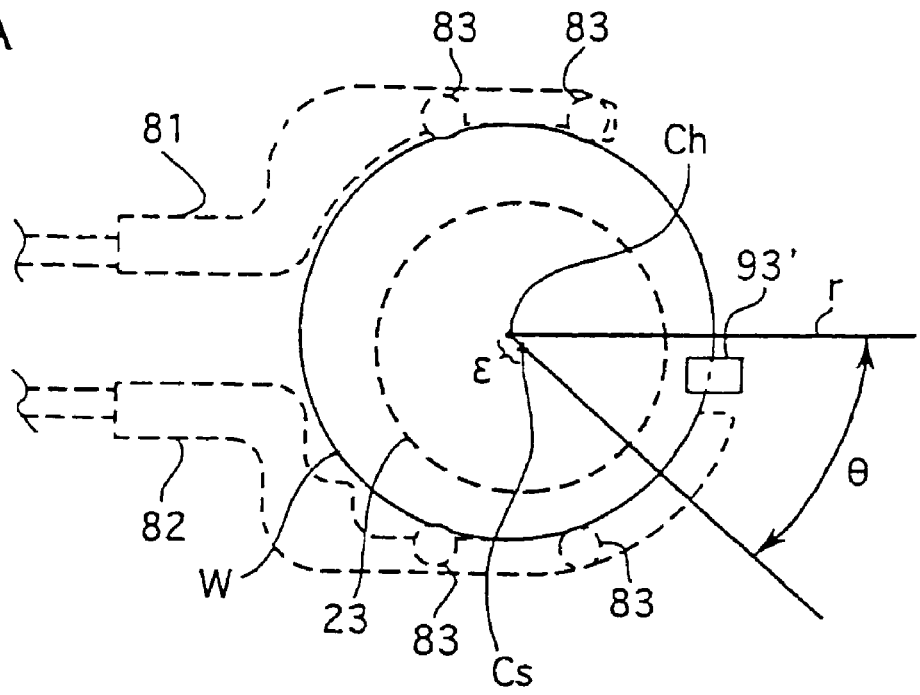
FIG. 13A is a plan view of a semiconductor wafer held by the wafer stage.

As shown in FIG. 13A, the displacement detecting part comprises an optical sensor 93' having a light emitter and a light receiver disposed such that the periphery of the wafer W held by the wafer stage 23 passes between the light emitter and the light receiver. As the wafer W is rotated, the optical sensor 93' detects the change in the quantity of light received by its light receiver as shown in FIG. 13B and the positional displacement in its radial direction (indicated by symbol $\epsilon$ in FIG. 13A) of the wafer W held by the wafer stage 23.

The displacement may be expressed by using the center (Ch) of the wafer W as the origin, and defining a polar coordinate system by using an arbitrary line (r) radially extending therefrom as a reference direction, in terms of the angle $\theta$ from this reference line r and the distance between the defined origin Ch and the center Cs of the wafer stage 23.

Figure 13B:
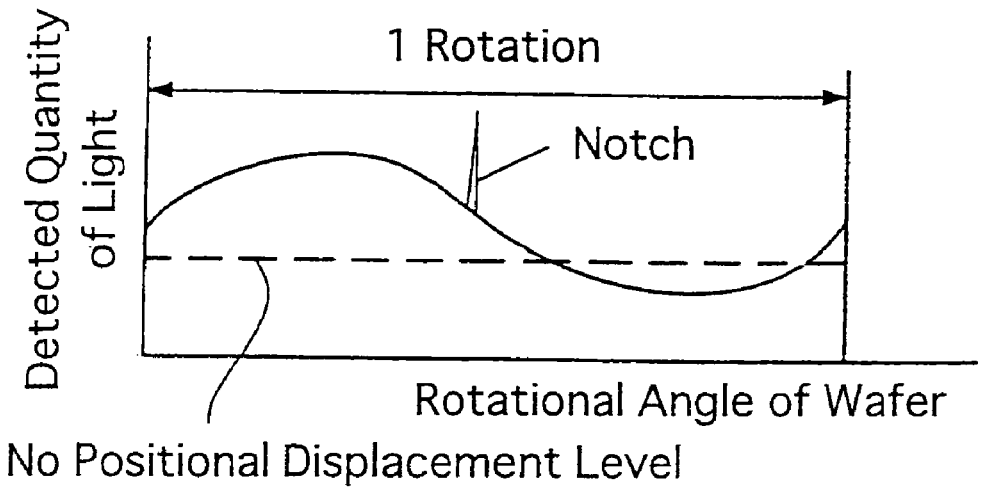
FIG. 13B is a graph for showing the change in the quantity of received light against the angle of rotation of the wafer.

As shown in FIG. 13B, the position of the notch is also detected, in addition to the positional displacement. The aforementioned positional displacement can be detected merely by rotating the wafer W once. In FIG. 13B, the broken line indicates the detected quantity of light when the center Ch of the wafer W coincides with the axis of rotation Cs of the wafer stage 23, that is, when there is no positional displacement.

FIGS. 6A and 6B show an example wherein the aforementioned third optical sensor 93 serves as this optical sensor for the displacement detecting part.

Explained more in detail with reference to FIGS. 14A, 14B and 14C, the third optical sensor 93 is disposed such that a portion of the light 99*c* from its light emitter will reach the light receiver and the periphery inclusive of the notch N of the wafer W held by the wafer stage 23 will pass between the light emitter and the light receiver while the wafer W is rotating in the direction of arrow R1. As the wafer W rotates, the third optical sensor 93 detects the changes in the quantity of light received by its light receiver and thereby detects the radial displacement of the wafer W adsorbed to the wafer stage 23. When the wafer stage 23 is rotating at a rotary speed in the aforementioned third range, the position of the notch N is further detected.

Figure 7A:
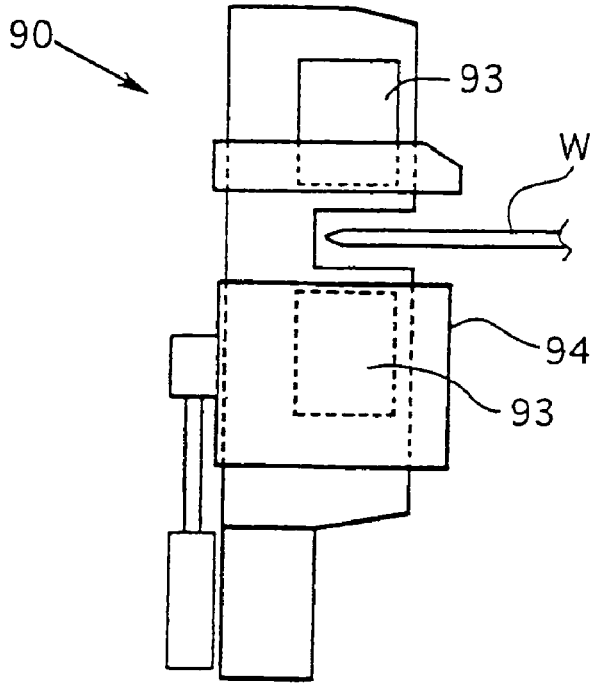
FIGS. 7A and 7B are each a side view of the sensor assembly.
Figure 7B:
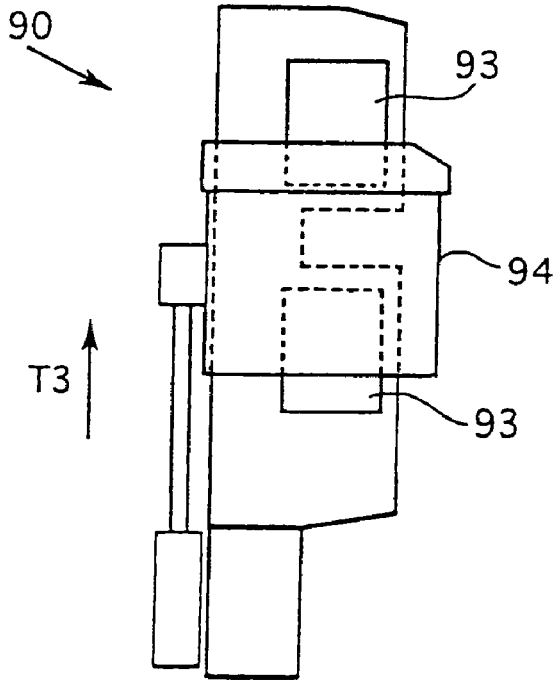

The sensor assembly 90 further comprises a waterproofing part for preventing damages to the optical sensors 91, 92 and 93 by the cooling liquid and the polishing liquid used for the tape-polishing of the wafer W. As shown in FIGS. 7A and 7B, this waterproofing part comprises an assembly rotating part for rotating the sensor assembly 90 (in the direction of arrow R2 shown in FIG. 6B) for retracting the optical sensors from the position of the wafer W and a shutter 94 for covering the retracted optical sensors. Although not shown, the assembly rotating part is adapted to rotate a shaft affixed to the sensor assembly 90 by driving a motor. The shutter 94 is adapted to be moved in the direction of arrow T3 as shown in FIG. 7B by means of an air piston to cover the optical sensors.

The bevel polishing part 50 may further comprise a second displacement detecting part for detecting the displacement of the wafer W while the beveled part of the wafer W is being polished. As shown in FIG. 11, the second displacement detecting part may comprise a displacement sensor (not shown) for detecting the change in the stretching and shrinking of a cylinder serving to compress the tape 53 to the beveled part of the wafer W through the contact pad 51 while the wafer W is being polished. As this displacement is detected, it is fed back to the stage moving part 30 and the displacement of the wafer W in its radial direction is corrected.

Although not shown, the device 10 according to this invention may further comprise a cleaning part for maintaining the interior of the housing 11 clean. Such a cleaning part may comprise an air inlet provided to the ceiling of the upper chamber 15 of the housing 11, an air discharge outlet provided to a lower portion on a side surface of the upper chamber 15 of the housing 11 and an external pump connected to this outlet such that the air that flows in through the air inlet will flow inside the housing 11 along its side surfaces. With an air flow thus formed inside the housing 11, particles can be discharged outward without becoming attached to the surface of the wafer W held by the wafer stage 23.

The device 10 according to this invention may further comprise a dryness preventing part for supplying pure water to the wafer W held by the wafer stage 23 such that the wafer W is prevented from becoming dry after each time it is polished by the notch polishing part 40 and the bevel polishing part 50 to be transported to the place of the next processing. As shown in FIGS. 2-4, this part comprises nozzles n1 and n2 provided inside the housing 11, and pure water is blown out therefrom towards the wafer W being transported. Since pure water is thus supplied to the wafer W while being transported, not only is the wafer W prevented from becoming dry but also particles are prevented from becoming attached to the wafer W.

Although two nozzles n1 and n2 are used according to the illustrated example, only one nozzle may be provided or more than two of them may be used. The nozzles are positioned such that the wafer W will not collide with them as the wafer stage 23 is caused to undergo the rotary reciprocating motion within the same plane as the surface of the wafer stage 23.

A method for polishing the peripheral edge part (both the notch and the beveled part) of a wafer W is explained next.

After the shutter 13 is driven by an air cylinder to open the opening 12 on the side surface of the housing 11 and the wafer W is transported into the upper chamber 15 of the housing 11 by using the robot hand 13', the wafer W is brought directly above the wafer stage 23 and the first and second chuck hands 81 and 82 at the wafer delivery position L2 are used to grasp the wafer W. At this moment, the center of the wafer W comes to a position directly above the center of the wafer stage 23 which is directly below. Thereafter, the robot hard 13' is retracted from the housing 11 and the shutter 13 is driven by the air cylinder to close the opening 12 of the housing 11.

While the wafer W remains thus grasped, the first and second chuck hands 81 and 82 are lowered to the wafer-setting position L3 and then are opened such that the wafer W is set on the pad 24. The first and second chuck hands 81 and 82 are raised to the retracted position L1. The vacuum pump is activated to hold the wafer W, adsorbed onto the wafer stage 23.

The sensor assembly 90 is rotated to position the optical sensors 91, 92 and 93 on the periphery of the wafer W held by the wafer stage 23, and the wafer stage 23 is rotated in the direction of arrow R1 to detect the position of the notch N. While the wafer stage 23 is still rotating, the positional displacement of the wafer W is also detected.

After the positional displacement of the wafer W is detected, the first and second chuck hands 81 and 82 are lowered to the wafer setting position L3 to grasp and lift up the wafer W. The wafer W is released from the suction force towards the wafer stage 23 by stopping the operation of the vacuum pump when the wafer W has been lifted up just a little. The wafer stage 23 is moved by the amount of the detected displacement, and the first and second chuck hands 81 and 82 are lowered to the wafer setting position L3 while grasping the wafer W as described above. These chuck hands 81 and 82 are then opened so as to set the wafer W on the wafer stage 23 and the vacuum pump is operated to hold the wafer W on the wafer stage 23 by suction. Thereafter, the wafer stage 23 is rotated as shown by arrow R1 as described above to detect the position of the notch by means of the optical sensors 91, 92 and 93 of the sensor assembly 90 as well as the positional displacement of the wafer W. This process may be repeated until the positional displacement ceases to be detected.

Next, the wafer stage 23 is moved towards the notch polishing part 40 such that the notch on the wafer W is pressed against the tape 43 of the notch polishing head 44. While a polishing liquid is supplied to the notch on the wafer W through the nozzle 48, the tape 43 is caused to run with the tape 43 remaining pressed against the notch and the wafer stage 23 is caused to undergo a rotary reciprocating motion in the direction of arrow R5 around the position of the notch in the same plane as the surface of the wafer W so as to polish the notch on the wafer W.

The notch is cooled during the polishing process by means of the polishing liquid supplied to the wafer W and the coefficient of friction at the notch is reduced. Debris produced by the polishing is prevented from scattering around. Although some debris may scatter around, scattered debris is washed off by the polishing liquid and does not become attached to the wafer W.

The notch polishing head 44 may be caused to undergo a vertical reciprocating motion or a rotary reciprocating motion (in the direction of arrow R3) to polish the edge E (shown in FIG. 1B) of the notch.

Next, the wafer stage 23 is moved towards the bevel polishing part 50 and the beveled part of the wafer W is pressed against the tape 53 through the contact pad 51. While the wafer stage 23 is thus moved, pure water is supplied to the wafer W through the nozzles n1 and n2 in order to prevent it from becoming dry.

The beveled part of the wafer W is polished by causing the tape 53 to run and the wafer stage 23 to rotate while the beveled part of the wafer W is pressed against the tape 53 and the polishing liquid is supplied to the beveled part of the wafer W through the nozzle 58.

The beveled part is cooled during the polishing process by means of the polishing liquid supplied to the wafer W and the coefficient of friction at the beveled part is reduced. Debris produced by the polishing is prevented from scattering around. Although some debris may scatter around, scattered debris is washed off by the polishing liquid and does not become attached to the wafer W.

The bevel polishing head 54 may be caused to undergo a vertical reciprocating motion or a rotary reciprocating motion (in the direction of arrow R4) to polish the edge E of the beveled part.

Although an example was shown wherein the polishing of the beveled part is done after the notch is polished, it goes without saying that the notch may be polished after the beveled part is polished.

The positional displacement of the wafer W may be detected while the beveled part is being polished. If a displacement is detected, this is fed back to the stage moving part 30 for correcting the positional displacement of the wafer W in its radial direction.

After both the beveled part and the notch are polished, the wafer stage 23 is returned to its original position. The first and second chuck hands 81 and 82 are lowered from the retracted position L1 to the wafer setting position L3 to grasp and lift up the wafer W. When the wafer W has been lifted a little, the vacuum pump is stopped and releases the wafer W from the suctioned condition and the first and second chuck hands 81 and 82 reach the wafer delivery position L2. The air cylinder drives the shutter 13 to open the opening 12 of the housing 11 and the robot hand 13' enters the housing 11 and comes to a position below the wafer W. The first and second chuck hands 81 and 82 open such that the wafer W is placed on the robot hand 13' and is transported out of the housing 11.

The invention claimed is:

1. A device for polishing the peripheral edge part of a semiconductor wafer, said device comprising:

a wafer stage having a surface for holding said semiconductor wafer;

a wafer stage unit including a stage rotating part for rotating said wafer stage and a reciprocating motion part for causing said wafer stage to undergo a rotary reciprocating motion in the same plane as said surface;

a stage moving part for moving said wafer stage parallel to said surface; and two or more polishing parts for polishing the peripheral edge part of said semiconductor wafer being held by said wafer stage;

wherein said reciprocating motion part serves to cause said wafer stage to undergo a reciprocating rotary motion around an axis that passes through a point on the outer periphery of said semiconductor wafer such that said semiconductor wafer undergoes a reciprocating rotary motion around a notch on said semiconductor wafer.

2. The device of claim 1 wherein said two or more polishing parts include a notch polishing part for polishing said notch on said semiconductor wafer held by said wafer stage and a bevel polishing part for polishing beveled part of said semiconductor wafer held by said wafer stage.

3. The device of claim 1 further comprising a housing that contains said wafer stage unit, said polishing parts and said stage moving part and has a side surface with an opening which can be opened and closed.

4. The device of claim 3 wherein said housing includes two chambers partitioned by a partition plate, one of said chambers containing said wafer stage unit and said polishing parts, and the other of said chambers containing said stage moving part.

5. The device of claim 1 further comprising a dryness preventing part for supplying pure water to said semiconductor wafer held by said wafer stage.

6. The device of claim 3 further comprising a chuck assembly for receiving said semiconductor wafer transported into said housing, placing said semiconductor wafer on said wafer stage and delivering said semiconductor wafer on said wafer stage to a wafer transporting part.

7. The device of claim 6 wherein said chuck assembly includes:

a first chuck hand having two or more knobs;

a second chuck hand having two or more knobs;

a chuck opening part for opening and closing said first chuck hand and said second chuck hand; and a chuck moving part for causing said first chuck hand and said second chuck hand to undergo a reciprocating motion perpendicularly to said surface of said wafer stage;

wherein said knobs contact peripheral parts of said semiconductor wafer when said first chuck hand and said second chuck hand are closed such that said semiconductor wafer becomes grasped by said first chuck hand and said second chuck hand.

8. The device of claim 7 wherein said chuck opening part comprises a ball screw engaging with at least one of said first and second chuck hands and a servo motor for driving said ball screw wherein said first and second chuck hands open and close as said servo motor is activated.

9. The device of claim 1 further comprising a sensor assembly having a notch detecting part for detecting the position of said notch on said semiconductor wafer being held on said wafer stage by suction.

10. The device of claim 9 wherein said notch detecting part includes an optical sensor having a light emitter and a light receiver arranged such that said notch on said semiconductor wafer held by said wafer stage by suction passes between said light emitter and said light receiver, said optical sensor serving to detect the position of said notch by rotating said semiconductor wafer.

11. The device of claim 10 wherein said optical sensor is one of three optical sensors which are first optical sensor, second optical sensor and third optical sensor, said first optical sensor being adapted to detect the position of said notch when said wafer stage is rotating at a rotational speed within a first range, said second optical sensor being adapted to detect the position of said notch when said wafer stage is rotating at a rotational speed within a second range that is slower than said first range, and said third optical sensor being adapted to detect the position of said notch when said wafer stage is rotating at a rotational speed within a third range that is slower than said second range.

12. The device of claim 9 wherein said sensor assembly further includes a displacement detecting part for detecting positional displacement in radial direction of said semiconductor wafer held by said wafer stage by suction, said displacement detecting part comprising an optical sensor having a light emitter and a light receiver arranged such that the peripheral edge of said semiconductor wafer held by said wafer stage by suction passes between said light emitter and said light receiver, said optical sensor serving to detect changes in the quantity of light received by said light receiver and to thereby detect a radial displacement of the position of said semiconductor wafer held by said wafer stage by suction.

13. The device of claim 11 wherein said third sensor is arranged such that the peripheral edge including said notch of said semiconductor wafer held by said wafer stage by suction passes between said light emitter and said light receiver, said third optical sensor serving to detect changes in the quantity of light received by the light receiver thereof and to thereby detect a radial displacement of the position of said semiconductor wafer held by said wafer stage by suction and to detect the position of said notch of said semiconductor wafer when said wafer stage is rotating at a rotary speed within said third range.

14. The device of claim 9 wherein said sensor assembly further comprises a waterproofing part for waterproofing said sensor assembly.

15. The device of claim 2 wherein said notch polishing part comprises:

a notch polishing head having a first roller and a second roller arranged parallel to each other with an interval in between; and a tape supplying part including a supply roll having a tape wound therearound, a take-up roller for taking up said tape from said supply roll through said first and second rollers and a driving part for driving said take-up roller for taking up said tape;

wherein said tape is adapted to be pressed against said notch while passing between said first roller and said second roller to thereby polish said notch.

16. The device of claim 15 wherein said tape comprises a tape-shaped base film of a plastic material having a polishing layer with abrading particles fastened by a resin binder.

17. The device of claim 15 wherein said notch polishing part further includes a mechanism for causing said notch polishing head to undergo a reciprocating motion perpendicularly to said semiconductor wafer while said tape is pressed against said notch.

18. The device of claim 15 wherein said notch polishing part further includes another mechanism for causing said notch polishing head to undergo a rotary reciprocating motion around said notch while said tape is pressed against said notch such that both front and back surface sides of said notch are polished.

19. The device of claim 15 wherein said notch polishing part further includes a diameter detecting part for detecting the outer diameter of said tape remaining wound around said supply roll.

20. The device of claim 2 wherein said bevel polishing part comprises:

a bevel polishing head having a cylinder with a contact pad attached to an end; and a tape supplying part having a supply roll having a tape wound therearound, a take-up roller for winding up said tape from said supply roll through said contact pad, and a driving part for driving said take-up roller for winding up said tape;

wherein said tape is pressed against said beveled part while passing on said contact pad and thereby polishes said beveled part.

21. The device of claim 20 wherein said tape comprises a tape-shaped base film of a plastic material having a polishing layer with abrading particles fastened by a resin binder.

22. The device of claim 20 wherein said bevel polishing part further includes a mechanism for causing said bevel polishing head to undergo a rotary reciprocating motion around said semiconductor wafer while said tape is pressed against said beveled part such that both front and back surface sides of said beveled part are polished.

23. The device of claim 20 wherein said bevel polishing part further includes a diameter detecting part for detecting the outer diameter of said tape remaining wound around said supply roll.

24. The device of claim 20 wherein said bevel polishing part further includes a displacement detecting part for detecting displacement of said semiconductor wafer while said beveled part is being polished, said displacement detecting part comprising a displacement sensor for detecting change in stretching and shrinking of said cylinder serving to compress said tape to said beveled part through said contact pad while said semiconductor wafer is being polished.

25. The device of claim 3 further comprising a cleaning part for maintaining the interior of said housing clean, said cleaning part comprising an air inlet through an upper surface of said housing, an air discharge outlet through a lower side surface of said housing and an external pump connected to said air discharge outlet, said air inlet and said air discharge outlet being arranged such that air flows in through said air inlet and flows inside said housing along side surfaces thereof.

26. The device of claim 4 further comprising a structure for waterproofing said other chamber.

27. The device of claim 4 wherein said partition plate has an opening;

wherein said stage rotating part comprises a first shaft attached to the center on the back of said wafer stage, a support member rotatably attached to said first shaft and a first motor for rotating said first shaft;

wherein said reciprocating motion part comprises a second shaft that is affixed to the support member of said wafer stage at a position offset from the center of said wafer stage by approximately the distance of one half of the radius of said semiconductor wafer through said opening through said partition plate and a second motor for rotating said second shaft, said second shaft being rotatably attached to a shaft table that is hollow and cylindrical, said shaft table having a lower surface affixed to a support plate below said partition plate and an upper surface supporting said support member by contacting the lower surface of said support member and said second motor being affixed to said support member; and wherein said device further comprises a hollow semi-spherical waterproofing cover having an upper affixed in a liquid-tight manner to an upper part of said shaft table and a lower part affixed in a liquid-tight manner around said opening through said partition plate, said waterproofing cover being made of an elastic material.

28. The device of claim 27 wherein said waterproofing cover is of a double structure having an inner cover and an outer cover, said device further comprising an air supplying part for supplying compressed air into a space between said inner cover and said outer cover.

* * * * *